US009010591B2

(12) United States Patent
Paulitsch

(10) Patent No.: US 9,010,591 B2
(45) Date of Patent: Apr. 21, 2015

(54) CARRYING DEVICE

(71) Applicant: Bernhard Paulitsch, Unterbergen (AT)

(72) Inventor: Bernhard Paulitsch, Unterbergen (AT)

( * ) Notice: Subject to any disclaimer, the term of this patent is extended or adjusted under 35 U.S.C. 154(b) by 0 days.

(21) Appl. No.: 14/208,078

(22) Filed: Mar. 13, 2014

(65) Prior Publication Data

US 2014/0263488 A1 Sep. 18, 2014

(51) Int. Cl.
*A45F 5/00* (2006.01)
*A45F 3/02* (2006.01)

(52) U.S. Cl.
CPC ... *A45F 5/00* (2013.01); *A45F 3/02* (2013.01); *A45F 2200/0583* (2013.01)

(58) Field of Classification Search
USPC ..... 224/148.2, 148.6, 197, 201, 250, 604, 224/258
See application file for complete search history.

(56) References Cited

U.S. PATENT DOCUMENTS 3,923,222 A 12/1975 Groves
5,285,939 A 2/1994 Hogan
5,407,110 A 4/1995 Marsh, Jr.
5,505,353 A * 4/1996 Marsh, Jr. ..... 224/148.6

FOREIGN PATENT DOCUMENTS

CA 2 093 936 10/1993

OTHER PUBLICATIONS

Austrian Search Report dated Oct. 11, 2012, corresponding to the Foreign Priority Application No. AT13 043.

* cited by examiner

*Primary Examiner* — Brian D Nash
*Assistant Examiner* — Corey Skurdal
(74) *Attorney, Agent, or Firm* — Young & Thompson

(57) ABSTRACT

A device for carrying bottles includes a holding ring (2), in whose interior a container, in particular a bottle or a can (beverage can), can be accommodated. An annular loop (3) is assigned to the holding ring (2). The lower loop-like area (4) can be rubberized on the inside and can hold the container from below. The upper loop-like area (5) of the annular loop (3) is used to carry the device (1) together with the container in the hand or placed over a shoulder of a user. The annular loop (3) is firmly connected in an area (7) to the holding ring (2); conversely, another area (8) of the annular loop (3) opposite to the fastened area (7) can be moved relative to the holding ring (2) (arrow 9).

15 Claims, 2 Drawing Sheets

CARRYING DEVICE

FIELD OF THE INVENTION

The invention relates to a device for carrying containers, in particular bottles, cans, etc.

The invention is based on the object of making available a device of the above-mentioned type that is of simple design and that can be kept in compact form when not in use.

This object is achieved according to the invention with a device that comprises the features of claim 1.

Preferred and advantageous configurations of the invention are the subject matter of the subclaims.

SUMMARY OF THE INVENTION

As a result of the device according to the invention having a holding ring, the container, in particular the bottle, when the device is in use, is held up sideways and in addition comprises an annular loop that projects over the holding ring with its loop-like (U-shaped) ends past both sides (upward and downward in the position of use), and the container, in particular the bottle, is accommodated in the holding ring, held toward the bottom. The upper area of the annular loop can be used as a carrying strap for carrying in the hand or placed over the shoulder.

It is especially advantageous when both the holding ring and the annular loop are manufactured from belts or straps made of flexible material, in particular textile fabric.

In order to be able to adjust the device to various sizes of containers, it can be provided within the scope of the invention that the holding ring is a belt that is connected to a ring, whereby the ends of the belt overlap one another at a point of contact.

As an alternative, the holding ring can consist of a lengthwise elastic belt that is designed, e.g., in the manner of a rubber band.

Another way of adapting the device according to the invention arises when an area of the annular loop is connected to the holding ring, and another area of the annular loop can be adjusted relative to the holding ring. In this case, it can be provided that the adjustable area of the annular loop is guided onto the inner side of the holding ring in a strap that is connected to the holding ring.

Within the scope of the invention, it can be provided that the area of the annular loop that is below in the position of use, i.e., the area that supports the container that is accommodated in the device, in particular a bottle, from below, is coated, for example rubberized, to increase friction on the inside.

The length of the annular loop can be changeable. To this end, devices that are known in the art can be used to change the length of straps.

Consideration is also given to providing several devices, separated from one another, on the belt forming the holding device, via which the belt can be connected in a selected position to the holding ring.

Imprints, such as advertisements, can be applied both on the holding ring (in particular outside) and on the annular loop (inside and/or outside).

BRIEF DESCRIPTION OF THE DRAWINGS

Additional details and features of the invention follow from the description below of preferred embodiments based on the drawings.

Here.

DETAILED DESCRIPTION OF THE PREPARED EMBODIMENTS

Figure 1:
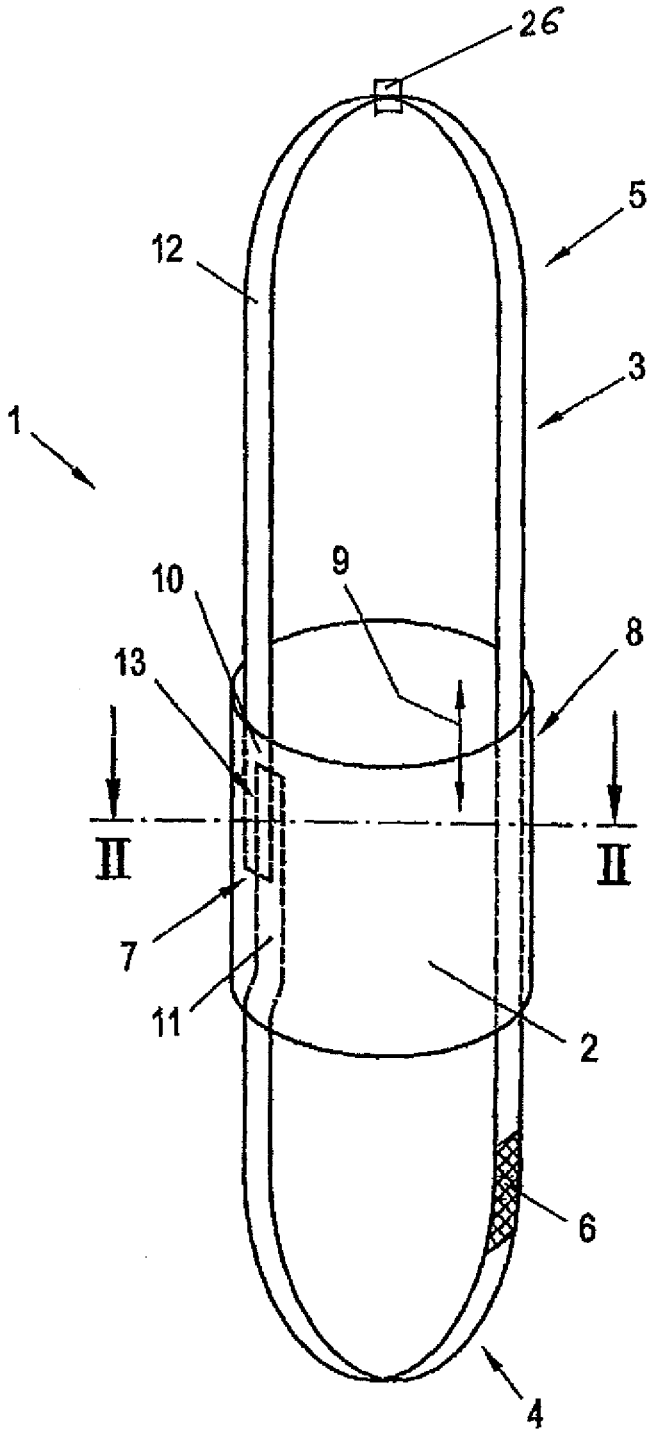
FIG. 1 shows diagrammatically and in oblique view a device according to the invention for carrying containers.

In the embodiment shown in FIG. 1, the device 1 according to the invention comprises a holding ring 2, which is designed, for example, as a sleeve made of elastic material, in particular textile material, whereby it is preferred that the material from which the holding ring 2 is formed is flexible. The holding ring 2 can be a belt 15 that is connected to a ring.

In addition, the device 1 according to the invention comprises an annular loop 3, whose two ends 4, 5 that are designed like a loop (or in the shape of a U) project over the holding ring 2 past both sides. In this case, the lower (shorter) loop 4 is assumed to be in the position of use that is shown in FIG. 1 to hold from the bottom a container, in particular a bottle, accommodated in the device 1 according to the invention in the interior of the holding ring 2. The other (longer) loop-like area 5 of the annular loop 3 that projects over the holding ring 2 upward in the position of use (FIG. 1) of the device 1 according to the invention is provided for carrying the device 1. The carrying can be done by the area 5 being gripped in the hand or being placed on a shoulder of a user.

The lower loop-like area 4 of the annular loop 3 in the position of use can be coated, in particular rubberized, on the inner side with a friction-increasing coating 6, so that a sideways slipping of the annular loop 3 of the container, in particular a bottle, accommodated in the device 1, is prevented or at least hindered. The rubberized area 6 of the annular loop 3 is only partially visible in FIG. 1 and is identified by cross-hatching.

In particular, it is provided within the scope of the invention that the annular loop 3 is firmly connected in an area 7 to the holding ring 2 and can be moved into an opposite area 8 relative to the holding ring 2, as is indicated by a double arrow 9 in FIG. 1.

This can be achieved simply in that the ends 10 and 11 are connected, for example, stitched, glued, or welded, to a belt 12, consisting of, for example, textile material (leather or plastic) and forming the annular loop 3 in the area of their point of contact 13 in the area 7 of the carrier ring 2 with the carrier ring 2. The area 8 of the belt 12 of the annular loop 3 that is opposite to the area 7 is accommodated between a strap 21 (not indicated in FIG. 1), which is provided in the interior of the holding ring 2, and the holding ring 2, and can move in the direction of the double arrow 9 relative to the holding ring 2.

Figure 2:
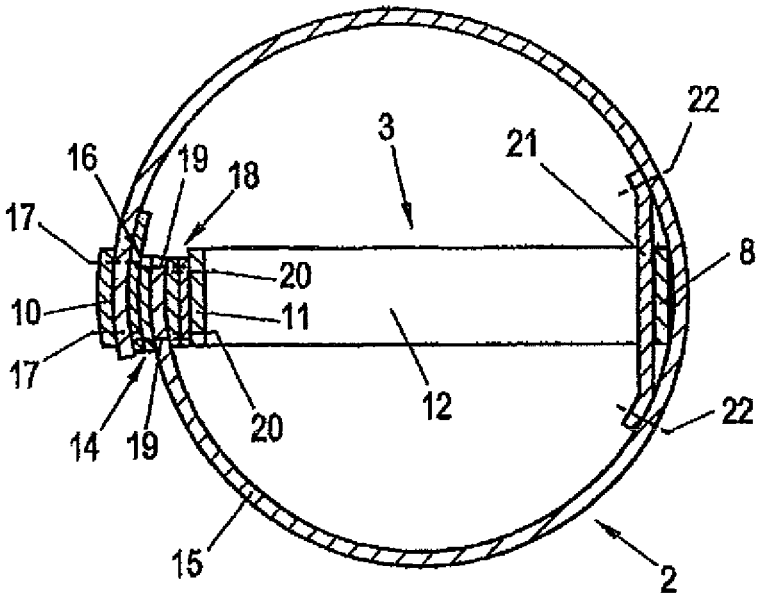
FIG. 2 shows a first embodiment in section along the line II-II of FIG. 1.

In section along the line II-II of FIG. 1, FIG. 2 shows a first embodiment of how the holding ring 2 and the annular loop 3 can be combined with one another. In the area of the point of contact 14 of the belt 15, from which the holding ring 2 is formed, a pair 16 of Velcro closures is provided. In this case, a part of the pair 16 of Velcro closures is connected, in particular stitched (seams 17), to one end and the second part is connected, in particular stitched (seams 17), to the other end of the belt 15 of the holding ring 2. With the seams 17, which connect one part of the pair 16 of Velcro closures to one end of the belt 15, the end 10 of the belt 12 of the annular loop 3 is also fastened on the belt 15 of the holding ring 2.

The second part of the pair 16 of Velcro closures is connected via seams 19 to the other end of the belt 15 of the holding ring 2, whereby the seams 19 also connect a part of another pair 18 of Velcro closures to this end of the belt 15. The second part of the pair 18 of Velcro closures is connected via seams 20 to the end 11 of the belt 12 of the annular loop 3.

With Velcro closures 16, 18, it thus is possible not only to connect the belt 15 to the holding ring 2, but rather the ends 10 and 11 of the belt 12, which forms the annular loop 3, can also be secured in the area 7 of the holding ring 2.

The area 8 of the annular loop 3, which can move relative to the holding ring 2, is accommodated in a movable manner, as mentioned, between a strap 21, which is connected via seams 22 to the holding ring 2, relative to the holding ring 2.

Figure 3:
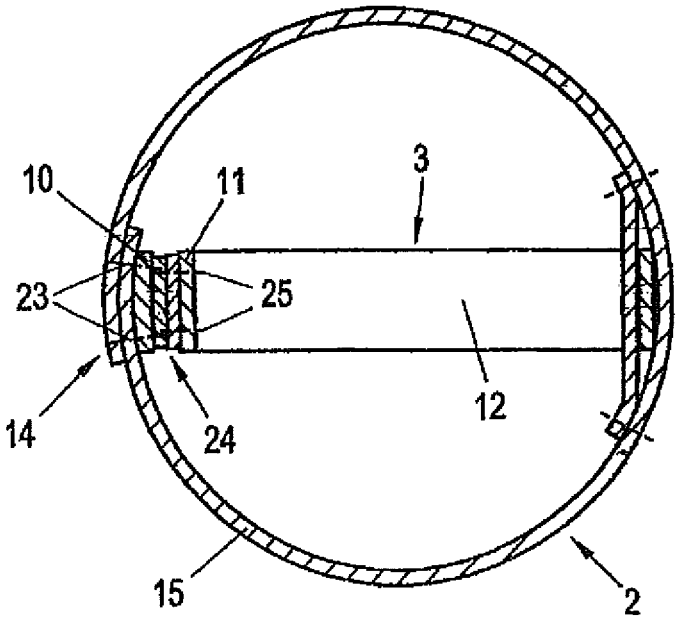
FIG. 3 shows a second embodiment in section along the line II-II of FIG. 1.

The simplified embodiment shown in FIG. 3 is distinguished from the embodiment shown in FIG. 2 in that the ends of the belt 15, which forms the holding ring 2, are connected to one another by seams 23 in the contact area 14. The seams 23 also simultaneously secure the end 10 of the belt 12, forming the annular loop 3, on the holding ring 2, in particular its point of contact 14 (in area 7).

The end 11 of the belt 12, which forms the annular loop 3, is fastened on the holding ring 2 with a pair 24 of Velcro closures. In this case, a part of the pair 24 of Velcro closures is connected by the seams 23 to the holding ring 2, and the other part of the pair 24 of Velcro closures is connected via seams 25 to the end 11 of the belt 12 of the annular loop 3.

When the belt 12 is connected to the annular loop 3 with a pair 18 of Velcro closures, it is preferred when the flange piece of the Velcro closure is arranged on the free end of the belt 12 and the hook piece of the Velcro closure is arranged on the end of the belt 12 that is connected to the holding ring 2.

This embodiment allows several flange pieces that are separated from one another to be provided on the belt 12; this makes it possible to adjust the size of the annular loop 3.

Within the scope of the invention, consideration is also given to providing pockets in or on the holding ring 2, in which, e.g., electronic components, e.g., an NFC module, can be accommodated. Such pockets are provided, for example, in the area 7 or in the area 8 of the holding ring 2.

The holding ring 2 itself can consist of an insulating material or a material with an increased storage capacity for heat, which, depending on whether it was heated above room temperature or cooled below room temperature, exerts a heating or cooling effect on the contents of the bottle. The holding ring 2 can also have pockets for inserts with such a material or can have a layer made from such a material that is applied inside or outside and that is optionally exchangeable.

In order to avoid the danger of injuries in the case of children, a safety device 26 can be arranged at any area of the annular loop, for example in the upper central area, which safety device forms a scoring, which tears away at a defined force. This scoring can either itself be an area of the annular loop that is of low strength or a closure that opens at a defined force.

In summary, an embodiment of the invention can be described as follows:

A device for carrying bottles comprises a holding ring 2, in whose interior a container, in particular a bottle or a can (beverage can), can be accommodated. An annular loop 3 is assigned to the holding ring 2. The lower loop-like area 4 can be rubberized on the inside and can hold the container from below. The upper loop-like area 5 of the annular loop 3 is used to carry the device 1 together with the container in the hand or placed over a shoulder of a user. The annular loop 3 is firmly connected in an area 7 to the holding ring 2; conversely, another area 8 of the annular loop 3 opposite to the fastened area 7 can be moved relative to the holding ring 2 (arrow 9).

The invention claimed is:

1. Device (1) for carrying containers, in particular bottles or cans, comprising:

a holding ring (2) consisting of a lengthwise elastic belt (15) having an interior side, an exterior side, an upper side, and a lower side;

a strap (21) provided on the interior side of the holding ring, and an annular loop (3) with two opposite ends that project respectively past the upper side and the lower side of the holding ring (2) to thereby define a upper loop area (5) and an opposite, lower loop area (4), wherein a first area (7) of the annular loop (3) is fixedly connected, at a point of contact (13, 14), to the holding ring (2), and another, second area (8) of the annular loop (3) is accommodated between the strap (21) and an adjacent portion of the interior side of the holding ring such that the second area (8) of the annular loop (3) is selectively movable (9)

i) upward above the upper side of the holding ring (2) to thereby increase a size of the upper loop area (5) and decrease a size of the lower loop area (4) relative to the holding ring (2), and ii) downward below the lower side of the holding ring (2) to thereby increase the size of the lower loop area (4) and decrease the size of the upper loop area (5) relative to the holding ring (2).

2. Device according to claim 1, wherein the annular loop (3) consists of flexible material.

3. Device according to claim 1, wherein ends of the belt (15) that form the holding ring (2) overlap one another at the point of contact (13, 14).

4. Device according to claim 3, wherein the ends of the belt (15) that form the holding ring (2) are detachably connected to one another.

5. Device according to claim 4, wherein the ends of the belt (15) are connected to one another by Velcro fasteners, buttons, buttonholes, buckles, clamping buckles, and/or snap fasteners.

6. Device according to claim 1, wherein the annular loop (3) is a belt (12) with overlapping two terminal ends (10, 11), the overlapping two terminal ends (10, 11) being fixedly connected to the annular loop (3) and the point of contact (13, 14).

7. Device according to claim 1, wherein the size of the annular loop (3) can be changed.

8. Device according to claim 1, wherein several flange pieces for Velcro closures are provided on the belt (12) of the annular loop (3).

9. Device according to claim 1, wherein at least one pocket is provided in the holding ring (2).

10. Device according to claim 9, wherein the pocket is provided in at least one of the first and second areas (7, 8).

11. Device according to claim 1, wherein the holding ring (2) has insulating, heating, or cooling properties.

12. Device according to claim 1, wherein a layer that consists of insulating, heating, or cooling material is applied on the holding ring (2).

13. Device according to claim 1, wherein an additional scoring or a closure that opens at a defined tensile force is arranged at the annular loop (3).

14. Device according to claim 2, wherein ends of the belt (15) that form the holding ring (2) overlap one another at the point of contact (13, 14).

15. Device according to claim 1, wherein the annular loop (3) consists of textile fabric.

* * * * *